United States Patent [19]

Fry

[11] Patent Number: 5,032,802

[45] Date of Patent: Jul. 16, 1991

[54] HYBRID DIRECTIONAL COUPLER CIRCUIT

[75] Inventor: Teny L. Fry, Davidsonville, Md.

[73] Assignee: Rose Communications, Inc., Santa Clara, Calif.

[21] Appl. No.: 477,677

[22] Filed: Feb. 9, 1990

[51] Int. Cl.[5] ..... H01P 5/18

[52] U.S. Cl. ..... 333/109; 333/116

[58] Field of Search ..... 333/109, 112–116; 455/323, 325

[56] References Cited

U.S. PATENT DOCUMENTS

| | | | |
|---|---|---|---|
| 2,803,750 | 8/1957 | Dayem | 333/113 X |
| 2,943,192 | 6/1960 | Liss | 333/109 X |
| 3,660,783 | 5/1972 | Cappucci | 333/110 |
| 4,701,724 | 10/1987 | Martin | 333/109 X |

*Primary Examiner*—Paul Gensler

*Attorney, Agent, or Firm*—Blakely, Taylor, Sokoloff & Zafman

[57] ABSTRACT

A hybrid network including a four port directional coupler with the terminating impedance of one port being intentionally mismatched with the characteristic impedance of the coupler. Such an intentionally mismatched port will cause the transfer signal of an input signal from an adjacent port to be reflected to another adjacent port and to be combined with the transfer signal of a second input signal, which is from an input port not isolated from the first input port. Placing the two input ports adjacent to one another also allows one input to radiate out of another adjacent input port. Alternately, a hybrid network is provided including a four port directional coupler with all ports properly terminated at the characteristic impedance of the coupler. An external combiner for signals from one port and its adjacent port allows the combining of two input transfer signals generated from the other two non-isolated input ports.

5 Claims, 3 Drawing Sheets

HYBRID DIRECTIONAL COUPLER CIRCUIT

BACKGROUND OF THE INVENTION

1. Field of the Invention

The present invention relates to the field of directional couplers. Particularly the present invention relates to hybrid directional couplers and its application to multi-input/multi-output signal wave guides.

2. Art Background

A directional coupler is a four-port wave guide in which an incoming wave at any one port appears at the 2 adjacent ports but not at the non-adjacent fourth port. This device is employed in wave guide networks such as microwave wave guides, integrated optics, and optical fibers.

A simple example of directional coupling is shown with reference to FIG. 1. Two conductors 10, 20 are oriented side by side over a conducting plane. The current I in conductor 10 will induce a current $I_m$ in conductor 20 because of magnetic coupling. The actual value of the current will depend on the external circuitry attached to the conductors but it will be assumed that the two of them extend to infinity in both directions. Since capacitive coupling exists also, a second set of current components denoted by $I_c$ will flow. The result is that a wave traveling toward the right in conductor 10 will produce a wave traveling toward the left in conductor 20. Such coupling is called contradirectional coupling since the induced wave travels in the opposite direction to the generating wave.

The sections of transmission lines which are in close proximity to one another function as transformers with the feature that the coupling is directional. An example of using the effective directional coupling is shown by FIG. 2 which shows two sources coupled to the common load without cross-coupling of power from one source to the other. This configuration is referred to as a hybrid combiner or coupler and is often used to combine the outputs of two solid state amplifiers in order to increase the power handling capability. This provides the use of less expensive low power devices.

Referring to FIG. 2, the circuit operates as follows: a wave from a signal generator 40 located at the left end of transmission line 50 travels toward the right and induces a wave on transmission line 60 that travels toward the left and on into the load 70. No wave is induced on line 60 that travels toward the right except for a small fraction of power. A similar situation exists with the second signal generator 80 connected at the right end of transmission line 60. A wave is induced on line 50 that travels toward the right since the load is also connected to the right end of line 50. Power in the induced wave will be dissipated here with little energy reaching the generator 40 at the end of line one.

For further information on directional couplers and hybrid couplers, in particular, see, *Radio Amateur Handbook* (American Radio Relay League 1989) and *McGraw-Hill Encyclopedia of Science and Technology*, Vol. 15, pp. 338–340 (6th Edition 1987).

In order to maximize the amount of power coupled and induced on the second signal line and to minimize the negative or destructive effects which may occur, each port of the hybrid device is terminated to a common impedance. By terminating each port to the characteristic impedance of the device, the negative effects of backwards crosstalk caused by reflections generated by a signal traveling between mismatched impedances of media are avoided.

SUMMARY OF THE INVENTION

It is therefore an object of the present invention to provide a hybrid directional coupler in which the input signals are not isolated from one another such that each input signal is output to the port to which the other signal is input and in which the two input signals are both output to a third port.

In the hybrid directional coupler of the present invention means are provided to cause each input signal to be outputted to the port to which the other input signal is inputted, and for causing the two input signals to be outputted to a third port. This is quite different from the typical operation of hybrid directional couplers in which the two input signals are isolated from one another and the input signal through one port is output through two adjacent ports. In the hybrid directional coupler of the present invention, means are provided for placing the first source device which generates the first input signal and the second source device which generates the second input signal to adjacent ports such that the first signal is output to the port to which the second source device is attached and the second signal is output to the port to which the first source device is attached. In addition, means are provided for connecting the first input signal to the port at which the second input signal is output. This may be achieved by intentionally terminating the third port to which the second input signal is output at an impedance different from the characteristic impedance of the directional coupler such that the second signal input is reflected back from the third port to the two adjacent ports, wherein the reflected signal is combined with the signal generated by the first signal from the first port. Alternately, means are provided to properly terminate the third port to the characteristic impedance of the directional coupler so as to absorb all energy at the third port. Means are also provided for connecting the fourth port to a combiner to which the first signal output port is also connected such that the second input signal generated by the second source device, and initially output to the third port, is combined with the first signal output generated first input by the signal.

BRIEF DESCRIPTION OF THE DRAWINGS

The objects, features, and advantages of the present invention will be apparent from the following detailed description of the invention which.

DETAILED DESCRIPTION OF THE INVENTION

Figure 1:
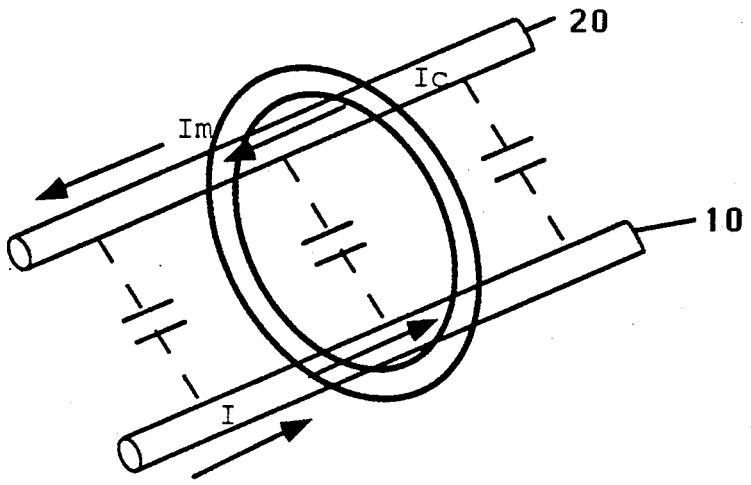
FIGURE 1 (Prior Art)
FIG. 1 is a diagram which illustrates the prior art directional couplers.
Figure 2:
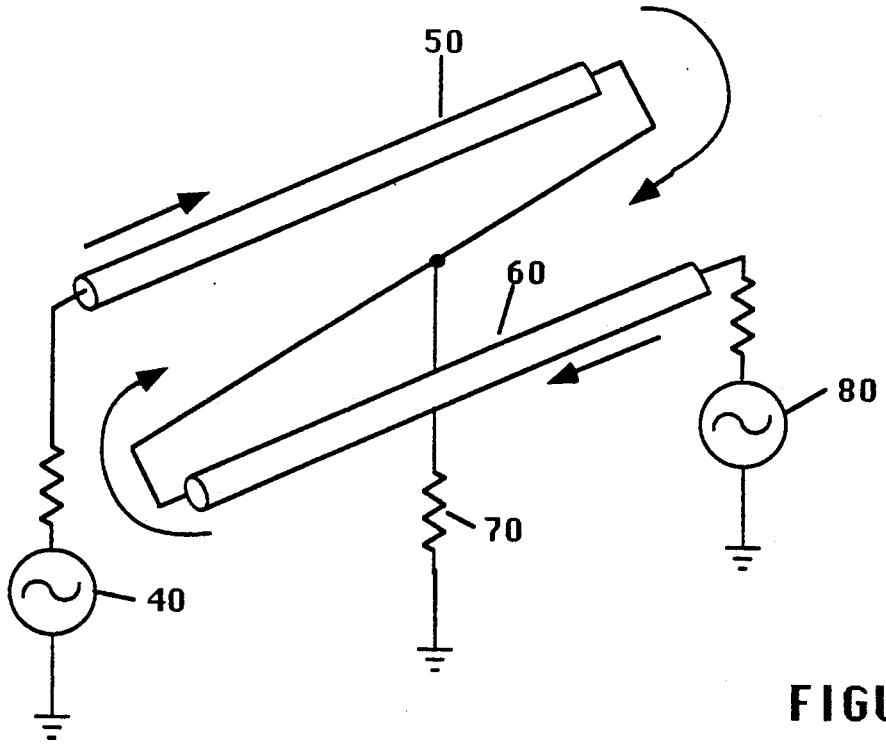
FIGURE 2 (Prior Art)
FIG. 2 is a diagram which illustrates the operation of prior art hybrid directional couplers.
Figure 3:
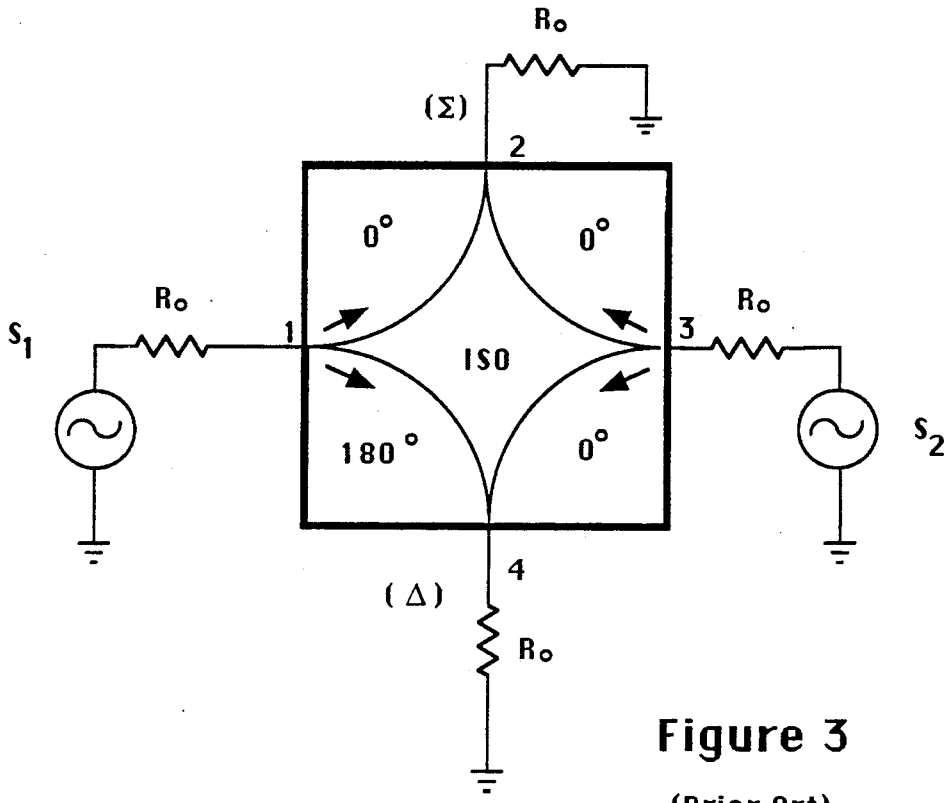
Figure 3 (Prior Art)
FIG. 3 is a structural diagram of a prior art 180° hybrid directional coupler.

FIG. 3 is a block diagram illustration of a four port 180° hybrid which is typically used to combine otherwise isolated signal sources or produce a difference of the two sources. In these applications, sources are positioned on isolated ports and energy is measured from either one or both remaining ports while terminating any unused ports to the characteristic impedance of the device.

Referring to FIG. 3, source S1 generates a first input signal input through port 1 and source S2 generates second input signal input through port 3. The sum of the input signals are inputted on port 2 and the difference of the two signals are outputted on port 4. As shown in FIG. 3, each of the four ports is coupled equally to the adjacent port pair with a relative phase difference as indicated, but isolated from the directly opposite port by the isolation of the device.

Figure 4:
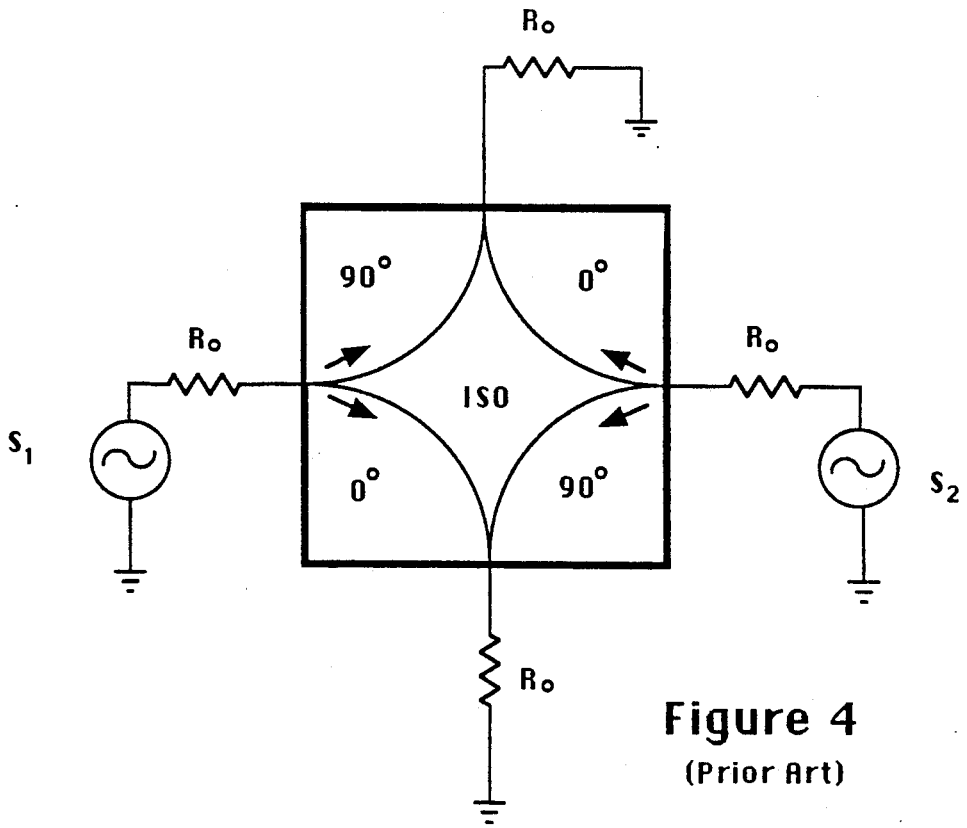
Figure 4 (Prior Art)
FIG. 4 illustrates a prior art 90° hybrid direction coupler.

A quadrature or 90° hybrid is a similar four port device differing in the relative phase differences between coupled ports as illustrated by FIG. 4. As with the 180° hybrid, the power entry in any given port is evenly divided between the two adjacent ports.

Figure 5:
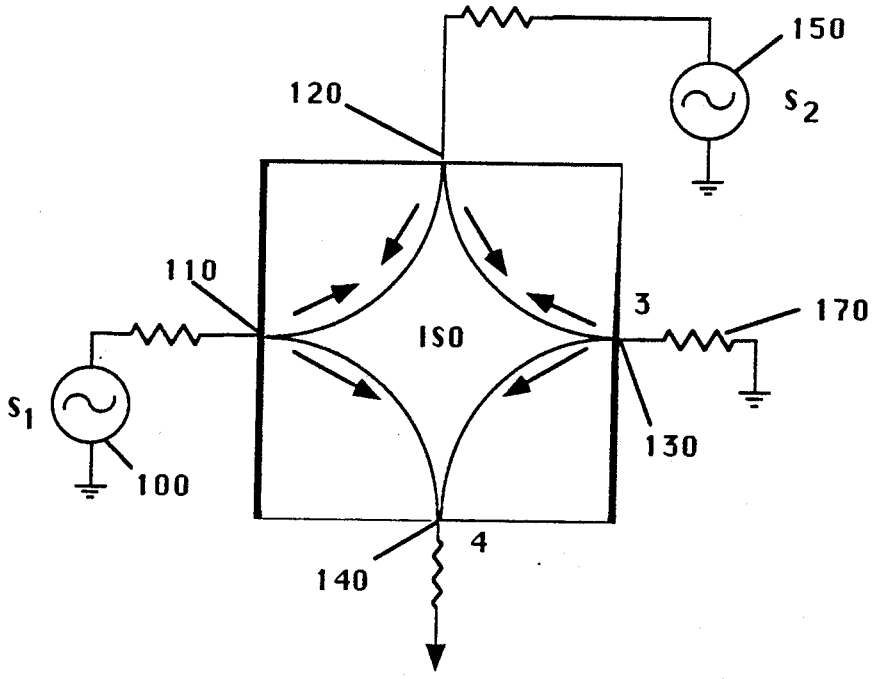
FIG. 5 illustrates a first embodiment of the hybrid directional coupler of the present invention.

In the four port hybrid of the present invention, the source devices are connected to adjacent ports such that the first signal generated by the first source device is outputted to the port to which the second source device is attached and the second source input signal generated by the second source device is outputted to the port to which the first source device is attached. This is illustrated by FIG. 5. Source input 100 is inputted to the hybrid through port 110 and the signal generated by the second source input 150 is inputted to the circuit through the second port 120. Thus signals generated by source 100 are outputted to the second port 120 to which the second input device is attached and to the fourth port 140, shown here connected to the same impedance as the characteristic impedance of the four-port directional coupler. The signal generated by the second source device 150 similarly is outputted to the first port 110 to which the first source 100 is connected to, and to the third port 130. In order to direct the second signal to the fourth port 140 such that both the first and second signal are output to the fourth port, the third port 130 is terminated to an impedance different from the characteristic impedance of the device. Preferably, this impedance is greatly different from the characteristic in the impedance of the device such that the amount of reflections (crosstalk) produces a detectable signal at the fourth port 140 (as well as the second port 120). For example, the impedance may be purposely modified by resistor 170 to provide an impedance at the third port 130 which is double the characteristic impedance of the device. Alternatively, the port can be purposely left unterminated which also will provide a mismatched impedance at the port. Therefore, the first and second signals generated by the first and second source devices are output to the fourth part 140.

Figure 6:
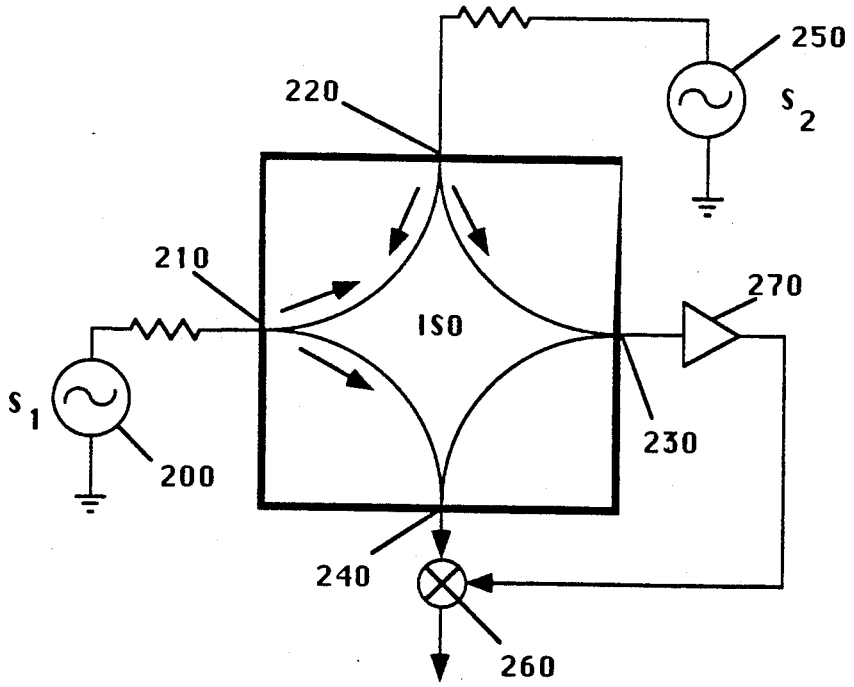
FIG. 6 illustrates second embodiment of the hybrid directional coupler of the present invention.

A second embodiment of the hybrid directional coupler of the present invention is illustrated by FIG. 6. Referring to FIG. 6, the input signal generated by the first source device 200 is inputted through input port 210 and the input signal generated by the second source device 250 is input through port 220. In as much as the first source device 200 and second source device 250 are connected to adjacent ports 210, 220, the signal generated by the first source device 200 is output to the second port 220 to which the second source device 250 is attached and the second signal generated by the second source device 250 appears at the first port 210 to which the first source device 200 is attached. The signal generated by the first source device 200 furthermore induces a signal to appear on the fourth port 240 and the signal generated by the second source device 250 induces a signal to appear at the third port 230. In this embodiment, the third port is terminated through amplifier 270 to the characteristic impedance of the four-port directional coupler such that the signal energy which appears at the third port 230 is absorbed and is not reflected back to the second and fourth ports 220, 240. In the present illustration, the direct external connection between the third and fourth ports 230, 240 may be made between the ports themselves or between components attached to the ports. A mixer device 260 is used to combine in a predetermined manner the signal which appears at the fourth port 240, that is, the first signal generated by the first signal source 200 with the signal output of the third port through amplifier 270, that is, the second signal generated by the second source device 250.

The invention has been described in conjunction with the preferred embodiment. Numerous alternatives, modifications, variations, and uses will be apparent to those skilled in the art of the foregoing description.

I claim:

1. A hybrid network comprising:

a bisymmetric directional coupler having first, second, third and fourth ports, the first port being adjacent to the second and fourth ports, the second port being adjacent to the first and third ports, the third port being adjacent to the second and the fourth ports, and the fourth port being adjacent to the first and third ports; said coupler being responsive to an input signal applied to any of the first, second, third and fourth port by transferring the input signal to two adjacent ports of said input port; said first port being isolated from said third port and said second port being isolated from said fourth port;

means for connecting a first source device to said first port at a characteristic impedance of the coupler and connecting a second source device to said second port at said characteristic impedance of the coupler, said first source device generating a first input signal to the coupler and said second source device generating a second input signal to the coupler; and means for terminating the third port at an impedance different from said characteristic impedance of said directional coupler such that said second input signal transferred to the third port is reflected back from the third port to the adjacent second and fourth ports;

wherein the first input signal is transferred and output to the second and fourth ports, and said second input signal is transferred to the fourth port where it combines with said transferred first input signal.

2. The hybrid network as described in claim 1, wherein the third port is terminated at an impedance twice said characteristic impedance of said directional coupler.

3. The hybrid network as described in claim 1, wherein the third port is left unterminated such that the third port is at an impedance different from said characteristic impedance of said coupler and the signal is reflected back from the third port to the adjacent second and fourth ports.

4. A hybrid network comprising:

a bisymmetric directional coupler having first, second, third and fourth ports, the first port being adjacent to the second and fourth ports, the second port being adjacent to the first and third ports, the third port being adjacent to the second and the fourth ports, and the fourth port being adjacent to the first and third ports; said coupler being responsive to an input signal applied to any of the first, second, third and fourth port by transferring the input signal to two adjacent ports of said input port; said first port being isolated from said third port and said second port being isolated from said fourth port;

means for connecting a first source device to said first port at a characteristic impedance of the coupler and connecting a second source device to said second port at said characteristic impedance of the coupler, said first source device generating a first input signal to the coupler and said second source device generating a second input signal to the coupler;

means for terminating the third port at said characteristic impedance of said coupler such that said second input signal is transferred to and output the coupler at the third port; and means for externally combining said transferred second input signal at the third port with a transferred first signal input at the fourth port;

wherein said transfer signal at the third port generated by the input from the second port is combined with said transfer signal at the fourth port generated by the input from the first port, and the first input signal is transferred and output to the second port.

5. The hybrid network as described in claim 4, wherein the output from the third port is passed through an amplifier means.

* * * * *

UNITED STATES PATENT AND TRADEMARK OFFICE

CERTIFICATE OF CORRECTION

PATENT NO. : 5,032,802

DATED : 7/16/91

INVENTOR(S) : Fry

It is certified that error in the above-identified patent and that said Letters Patent is hereby corrected as shown below:

On the title page:

| | |
|---|---|
| [75] Inventor: | delete "Teny" insert --Terry-- |
| [56] *Attorney, Agent or Firm* - | delete "Blakely, Taylor, Sokoloff & Zafman" insert --Blakely, Sokoloff, Taylor & Zafman-- |
| col. 02, line 45 | delete "first input by the signal" insert --by the first input signal-- |

Signed and Sealed this

Third Day of December, 1991

*Attest:*

*Attesting Officer*

HARRY F. MANBECK, JR.

*Commissioner of Patents and Trademarks*